United States Patent [19]

Witt et al.

[11] Patent Number: 4,622,900

[45] Date of Patent: Nov. 18, 1986

[54] EXPLODING MISSILE

[75] Inventors: Wolfram Witt; Hendrick Lips; Herbert Scholler; Raimund Schweiger, all of Duesseldorf, Fed. Rep. of Germany

[73] Assignee: Rheinmetall GmbH, Duesseldorf, Fed. Rep. of Germany

[21] Appl. No.: 624,042

[22] Filed: Jun. 25, 1984

[30] Foreign Application Priority Data

Jun. 25, 1983 [DE] Fed. Rep. of Germany ..... 3322927

[51] Int. Cl.[4] ..... F42B 13/00; F42B 1/02; F42B 25/02

[52] U.S. Cl. ..... 102/387; 102/211; 102/214; 102/476

[58] Field of Search ..... 102/476, 475, 387, 388, 102/386, 425, 306, 211–214

[56] References Cited

U.S. PATENT DOCUMENTS

| | | | |
|---|---|---|---|
| 2,432,920 | 12/1947 | McKay et al. | 102/387 |
| 3,439,610 | 4/1969 | Myers | 102/388 X |
| 3,527,167 | 9/1970 | Morse | 102/476 X |
| 3,818,833 | 6/1974 | Throner | 102/214 X |
| 3,875,862 | 4/1975 | Fischer et al. | 102/425 |
| 4,050,381 | 9/1977 | Heinemann | 102/476 X |
| 4,160,415 | 7/1979 | Cole | 102/214 |
| 4,207,841 | 6/1980 | Bloomer | 102/214 |
| 4,296,685 | 10/1981 | Romer et al. | 102/387 |

FOREIGN PATENT DOCUMENTS

| | | | |
|---|---|---|---|
| 2856610 | 1/1983 | Fed. Rep. of Germany | 102/476 |
| 2478297 | 9/1981 | France | 102/387 |
| 1444029 | 7/1976 | United Kingdom | 102/387 |

*Primary Examiner*—David H. Brown

[57] ABSTRACT

An exploding missile has a casing and a parachute attached to the casing for making it move in a predetermined direction relative to the casing after launch. A charge in the casing has a projectile-forming front face, facing forward in the travel direction. An antenna is provided on the casing behind the front face and charge and is displaceable between a retracted position wholly behind the charge and an extended position projecting laterally therefrom and directed at least generally forwardly in the direction past the charge. An actuator is connected between the casing and the antenna for moving same from the retracted into the extended position after launch of the missile. A controller including a receiver connected to the antenna and a detonator in the charge detects the distance to a target in front of the missle and explodes the charge when a predetermined distance is detected or the target is otherwise sensed. The antenna is deployed after launch in a position capable of scanning forward of the obstacle to the secondary projectile, when that goes off.

8 Claims, 6 Drawing Figures

EXPLODING MISSILE

FIELD OF THE INVENTION

The present invention relates to an exploding projectile or bomb. More particularly this invention concerns such a msisile which detonates or explodes to form a secondary projectile as it nears its target.

BACKGROUND OF THE INVENTION

A missile that is dropped from an airplane or fired from a large artillery piece so as to descend onto its target while suspended from a parachute can be provided with a target-sensing unit that explodes a charge in the missile when same nears the target. This charge therefore lies behind, in the downward direction of travel, of a projectile- or shrapnel-forming layer, so that when it explodes this layer is projected in one or many pieces at the target. Such devices are particularly effective against armored vehicles which cannot be breached by projectiles that have moved through a long distance and, therefore, lost most of their speed and momentum.

Typically the target-sensing device is a radar-like transmitter and receiver, most often one that detects the distance to the underlying ground so that the charge can be detonated at the optimum altitude, which is fairly low and impossible to detect accurately by a simple barometer-type altimeter. The device could also be a simple receiver that detonates as it approaches a signal-emitting target or beacon thereon.

As described in German patent document No. 2,353,566, corresponding to British Pat. No. 1444029 the target-sensing unit comprises at least one antenna for transmitting and receiving, a transmitter, a receiver, and circuitry connected between the transmitter and receiver and to the detonator in the charge when the target is appropriately sensed. At least the antenna of this unit is provided, relative to the normal direction of travel of the missile, in front of the charge and the element forming the secondary projectile or projectiles when the charge is detonated. Thus in a system wherein the lower surface is provided with a hard layer that breaks up and forms shrapnel, the energy of at least some of this shrapnel will be absorbed as it impacts the back of the target-sensing unit. Clearly this reduces the effectiveness of the secondary detonation.

The effective size of the antenna can be reduced as described in copending and coassigned application Ser. No. 628,751, filed on July 9, 1984 after connecting the antenna to the radar transceiver by means of a tubular waveguide centered on an axis parallel to the projectile travel direction. This waveguide is imbedded in the charge and is in fact also packed with explosive which itself can be a neutral dielectric. Such an arrangement has several advantages, but still does at least minimally block the forward face of the missile that becomes the secondary projectile or projectiles.

OBJECTS OF THE INVENTION

It is therefore an object of the present invention to provide an improved exploding missile.

Another object is the provision of such an exploding missile which overcomes the above-given disadvantages, that is which does not waste some of its secondary detonation as described above.

SUMMARY OF THE INVENTION

An exploding missile according to the invention has a casing and means such as a parachute attached to or fins on the casing for making it move in a predetermined direction relative to the casing after launch. A charge in the casing has a proectile-forming front face, that is one facing forward in the travel direction. An antenna is provided on the casing behind the front face and charge and so as to be displaceable between a retracted position wholly behind the charge and an extended position projecting laterally therefrom and directed at least generally forwardly in the direction past the charge. An actuator is connected between the casing and the antenna for moving same from the retracted into the extended position after launch of the missile. A controller including a receiver connected to the antenna and a detonator in the charge detects the distance to or presence of a target in front of the missile and explodes the charge when the target is in range.

Thus the antenna is deployed after launch in a position capable of scanning forward of the projectile, but at a location where it presents no blockage or obstacle to the secondary projectile, when that goes off.

The antenna of this invention has a forwardly concave and center cup fixed on the casing behind the charge and a plurality of antenna segments displaceable on the cup between the positions. Together, the cup and the segments form, when the segments are deployed in their outer positions, a forwardly directed parabolic antenna that is perfect for the forward scanning required by the microwave equipment of this type.

The actuator can be connected to the segments by respective linkages, and can incorporate a small explosive charge to deploy these segments. It is also possible for the actuator to be an inflatable balloon engaging all of the segments and means such as a compressor or small gas bottle connected to the controller for inflating the balloon and moving the segments into the extended position. Normally the casing has removable panels covering and containing the antenna segments in the inner position thereof. These panels are dislodged from the casing to expose the antenna on inflation of the balloon. This is an extremely simple system, and can be simplified further by forming the segments as metallic or microwave-reflective material on the inner or outer surface of appropriate segmental portions of the actuator balloon.

DESCRIPTION OF THE DRAWING

The above and other features and advantages will become more readily apparent from the following, reference being made to the accompanying drawing in which.

SPECIFIC DESCRIPTION

Figure 1:
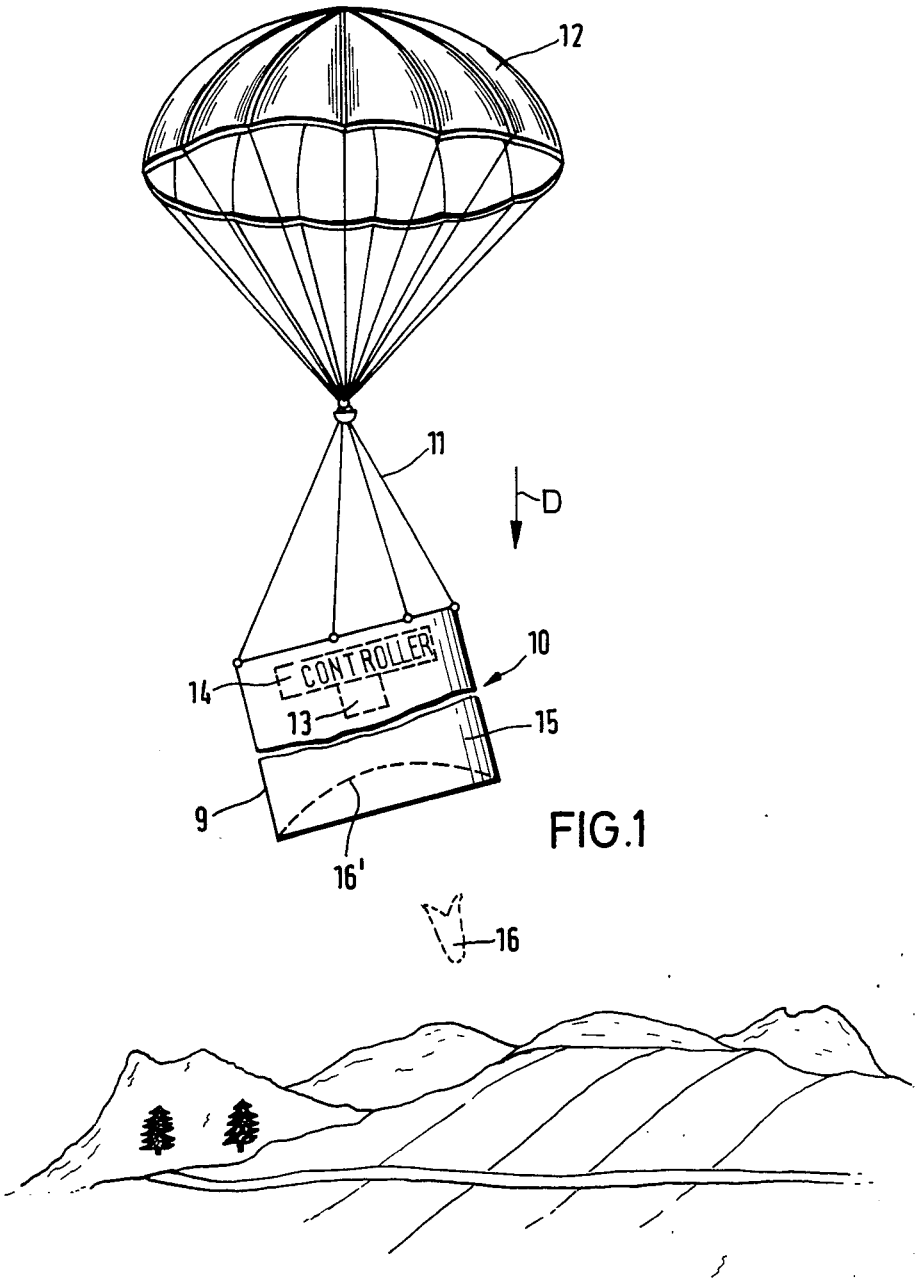
FIG. 1 is a perspective view of the missile according to this invention.

As seen in FIG. 1 a missile 10 according to this invention has a basically cylindrical casing or can 9 hanging via suspension lines 11 from a parachute 12 so as to fall in a direction D. The casing 9 contains a large explosive charge 15 having a forwardly cupped front face 16' that forms one or more secondary projectiles 16 when exploded by a detonator 13 under the control of a controller 14 that detects the proximity of the target or of the ground.

Figure 2:
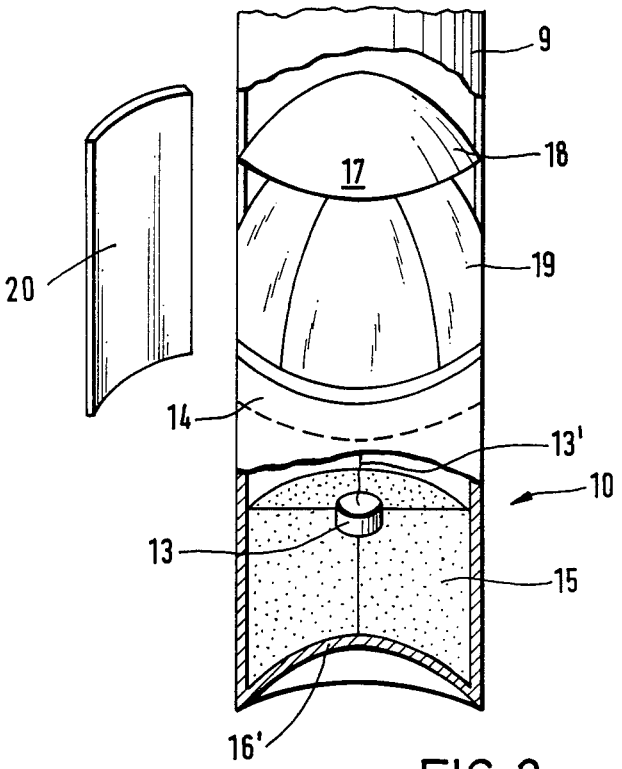
FIG. 2 is a partly sectional view through the missile in the prelaunch or predeployment position.
Figure 3:
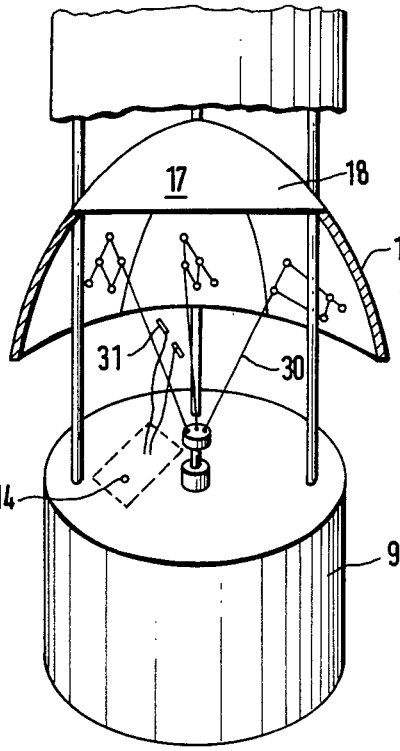
FIG. 3 is a view like FIG. 2 but showing the missile postlaunch and with the antenna deployed.

An antenna 17 has central emitters 31 connected to the transceiver of the controller 14. This antenna 17 is of the parabolic type centered on an axis parallel to the direction D and is formed as shown in FIG. 3 of a central forwardly concave cup 18 and a plurality ofidentical part-paraboloidal segments 19. The cup 18 has an outer rim that lies wholly within the axial extension of the cylindrical can 9 and abuts at this rim the inner rear edges of the segments 19 in the outer or deployed position of FIG. 3. Before such deployment these segments 19 are inwardly retracted as shown in FIG. 2, and in fact panels 20 cover the sides of the can 9 around them.

Figure 4:
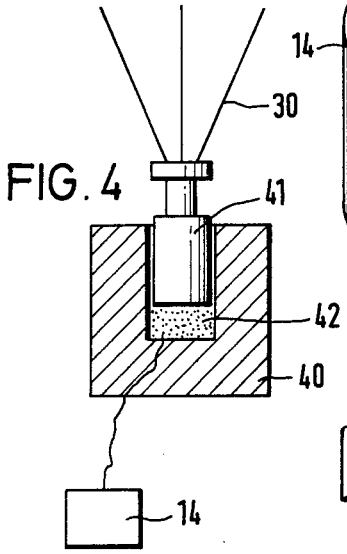
FIG. 4 is a large-scale sectional view of a detail of FIG. 3.

When launched, that is either fired from a large artillery piece or dropped from an airplane, the parachute 12 is deployed automatically. The controller 14 incorporates a timer or speed sensor so it can first eject the panels 20, then fire a small charge 42 contained in a cylinder 40 shown in FIG. 4. A piston 41 closing this cylinder 40 is connected via linkages 30 to the segments 19 so that when it is blown out of the cylinder 40 it deploys the antenna 17 into a position in which it is directed forward in the direction D. This deployment is of course triggered by the controller 14.

Figure 3A:
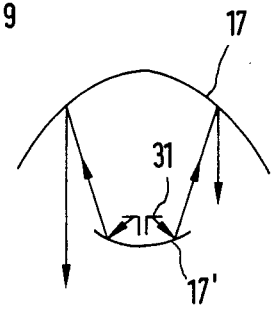
FIG. 3*a* is a schematic view illustrating a variation of the system of FIG. 3.

It is also possible as shown in FIG. 3*a* to use a double-reflector system comprising, in addition to the parabolic rear reflector 17, a smaller front reflector 17'. In this manner it is possible to aim an annular radar beam around the charge 15 relatively easily.

Figure 5:
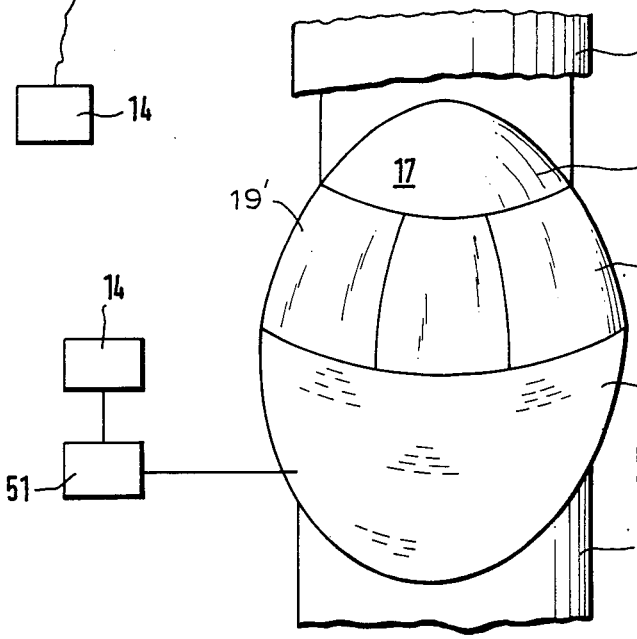
FIG. 5 is a view like FIG. 3 of another embodiment of this invention.

The arrangement of FIG. 5 uses a balloon 50 both to burst off the panels 20 and deploy the segments 19, In fact these segments can be nothing more than metallic microwave-reflecting coating 19' on appropriate portions of the inner or outer surface of this balloon 50. A gas supply 51 operated by the controller 14 serves to inflate the balloon 50.

Thus with the system of this invention the antenna is forwardly effective, yet wholly out of the way of the secondary projectiles 16. Thus these projectiles 16 will be fully effective.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

What is claimed is:

1. An exploding missile comprising:

a casing;

means attached to the casing for making a first portion of it move in a predetermined direction relative to the remainder of the casing after launch;

a charge in the casing having a projectile-forming front face;

an antenna on the casing behind the front face and charge and displaceable between a retracted position wholly behind the charge and an extended position projecting laterally therefrom and directed at least generally forwardly in the direction past the charge;

actuation means connected between the casing and the antenna for moving same from the retracted into the extended position after launch of the missile;

control means including a receiver connected to the antenna and a detonator in the charge for detecting the distance to a target in front of the missile and exploding the charge when a predetermined distance is detected;

the means for making the first portion of the casing move is a parachute attached to the casing.

2. The exploding missile defined in claim 1 wherein the control means further comprises a microwave transmitter connected to the antenna and working radar-fashion with the receiver.

3. The exploding missile defined in claim 1 wherein the antenna includes a forwardly concave and center cup fixed on the casing behind the charge and a plurality of antenna segments displaceable on the cup between the positions.

4. The exploding missile defined in claim 3 wherein the actuation means includes respective linkages connected to the segments and an actuator connected to all of the linkages.

5. The exploding missile defined in claim 4 wherein the actuator includes a small explosive charge.

6. The exploding missile defined in claim 3 wherein the actuator means includes an inflatable balloon engaging all of the segments and means connected to the control means for inflating the balloon and moving the segments into the extended position.

7. The exploding missile defined in claim 6 wherein the casing includes removable panels covering and containing the antenna segments in the inner position thereof, the panels being dislodged from the casing to expose the antenna on inflation of the balloon.

8. The exploding missile defined in claim 6 where the balloon has a metallic coating forming the antenna.

* * * * *